US009840394B2

(12) United States Patent
Chen et al.

(10) Patent No.: US 9,840,394 B2
(45) Date of Patent: Dec. 12, 2017

(54) WIRE-WINDING DEVICE

(71) Applicant: FOXCONN INTERCONNECT TECHNOLOGY LIMITED, Grand Cayman (KY)

(72) Inventors: Chi-Ming Chen, New Taipei (TW); Kai-Feng Yang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 467 days.

(21) Appl. No.: 14/555,512

(22) Filed: Nov. 26, 2014

(65) Prior Publication Data

US 2015/0144729 A1 May 28, 2015

(30) Foreign Application Priority Data

Nov. 26, 2013 (CN) ..... 2013 1 0612585

(51) Int. Cl.
*B65H 75/48* (2006.01)
*B65H 75/44* (2006.01)

(52) U.S. Cl.
CPC ..... *B65H 75/4434* (2013.01); *B65H 2701/34* (2013.01)

(58) Field of Classification Search
CPC . B65H 75/48; B65H 75/4434; B65H 2701/34
USPC ..... 242/378, 378.1, 378.2
See application file for complete search history.

(56) References Cited

U.S. PATENT DOCUMENTS

| | | | | |
|---|---|---|---|---|
| 7,028,939 | B2 | 4/2006 | Liao | |
| 7,222,812 | B2 | 5/2007 | Chang et al. | |
| 7,784,727 | B1 * | 8/2010 | Liao | B65H 75/4431 242/378.1 |
| 8,136,751 | B2 * | 3/2012 | Chen | B65H 75/4434 242/378.1 |
| 2006/0027433 | A1 * | 2/2006 | Wu | B65H 75/4434 191/12.2 R |
| 2007/0181730 | A1 * | 8/2007 | Yen | B65H 75/4434 242/378.1 |

(Continued)

FOREIGN PATENT DOCUMENTS

| | | |
|---|---|---|
| CN | 560521 | 11/2003 |
| CN | 2904412 Y | 5/2007 |
| CN | 101282032 A | 10/2008 |

(Continued)

*Primary Examiner* — William A Rivera
(74) *Attorney, Agent, or Firm* — Wei Te Chung; Ming Chieh Chang

(57) ABSTRACT

A wire-winding device comprising: an upper cover having a bottom surface and a slot deviating from a center of the bottom surface; a rotary base having an annular track on a top surface thereof, the annual track and the slot of the upper cover constituting an orbit; a spiral spring received in the rotary base; a transmission line winding around the rotary base; a lower cover assembled with the upper cover; and an elastic positioning element having a base and a positioning part extruding from the lower surface of the base, the base having an elastic part and a respective fixed part at each of two ends thereof, the elastic positioning element being moveable along the orbit in response to a rotational movement of the rotary base to avoid the transmission line to be tied a knot.

10 Claims, 11 Drawing Sheets

(56) References Cited

U.S. PATENT DOCUMENTS

| | | | | |
|---|---|---|---|---|
| 2009/0107789 | A1* | 4/2009 | Huang | B65H 75/4434 191/12.4 |
| 2011/0031341 | A1* | 2/2011 | He | B65H 75/4434 242/388.1 |

FOREIGN PATENT DOCUMENTS

| | | | |
|---|---|---|---|
| CN | 201210612 | Y | 3/2009 |
| CN | 102674084 | A | 9/2012 |
| JP | 3147572 | U | 1/2009 |
| TW | 2737004 | | 10/2005 |
| TW | M391789 | | 11/2010 |
| TW | M433397 | | 7/2012 |
| TW | M454688 | | 6/2013 |
| TW | M459596 | | 8/2013 |

* cited by examiner

WIRE-WINDING DEVICE

BACKGROUND OF THE INVENTION

1. Field of the Invention

The present invention relates to a wire-winding device, and more particularly to an improved wire-winding device with a better positioning structure.

2. Description of the Related Art

Taiwan Patent No. 560521 discloses a wire-winding device having a positioning structure where a ball and guide grooves are disposed between a rotary base and a cover. The ball and the rotary base function as a positioning structure to achieve a fixed position of a cable wound around the rotary base. However, the ball is so small in size that it may come off the guide groove when external impact occurs, resulting in damage of the wire-winding device.

SUMMARY OF THE INVENTION

Accordingly, an object of the present invention is to provide a wire-winding device having an improved cable wire positioning structure.

In order to achieve the object set forth, the wire-winding device comprising: an upper cover having a bottom surface and a slot deviating from a center of the bottom surface; a rotary base having an annular track on a top surface thereof, the annular track and the slot of the upper cover constituting an orbit; a spiral spring received in the rotary base; a transmission line winding around the rotary base; a lower cover assembled with the upper cover; and an elastic positioning element having a base and a positioning part extruding from the lower surface of the base, the base having an elastic part and a respective fixed part at each of two ends thereof, the elastic positioning element being moveable along the orbit in response to a rotational movement of the rotary base to avoid the transmission line to be tied a knot.

DESCRIPTION OF PREFERRED EMBODIMENT

Figure 1:
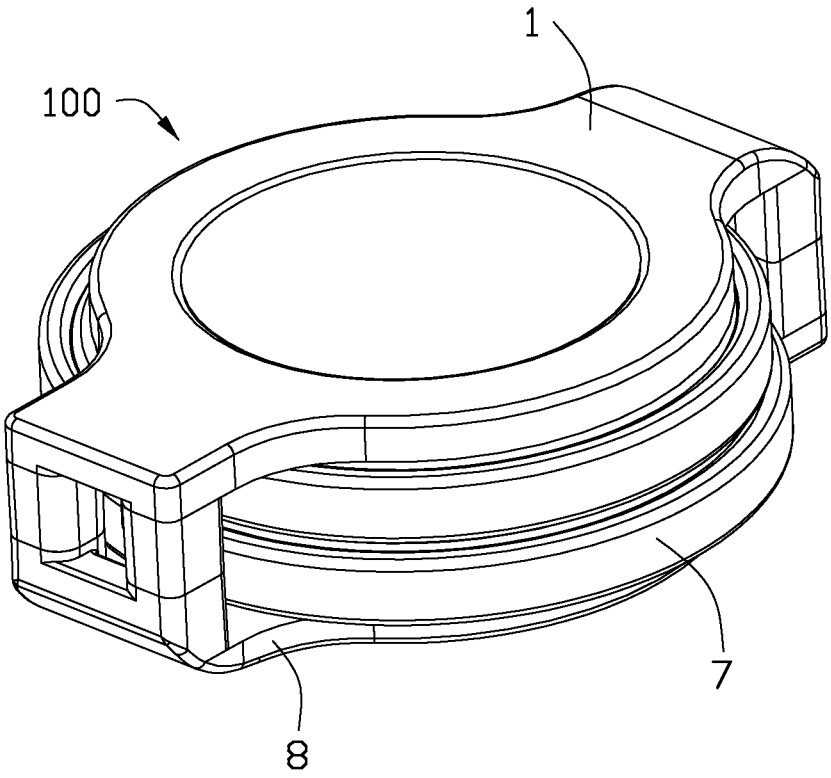
FIG. 1 is an assembled, perspective view of a wire-winding device in accordance with the present invention.
Figure 2:
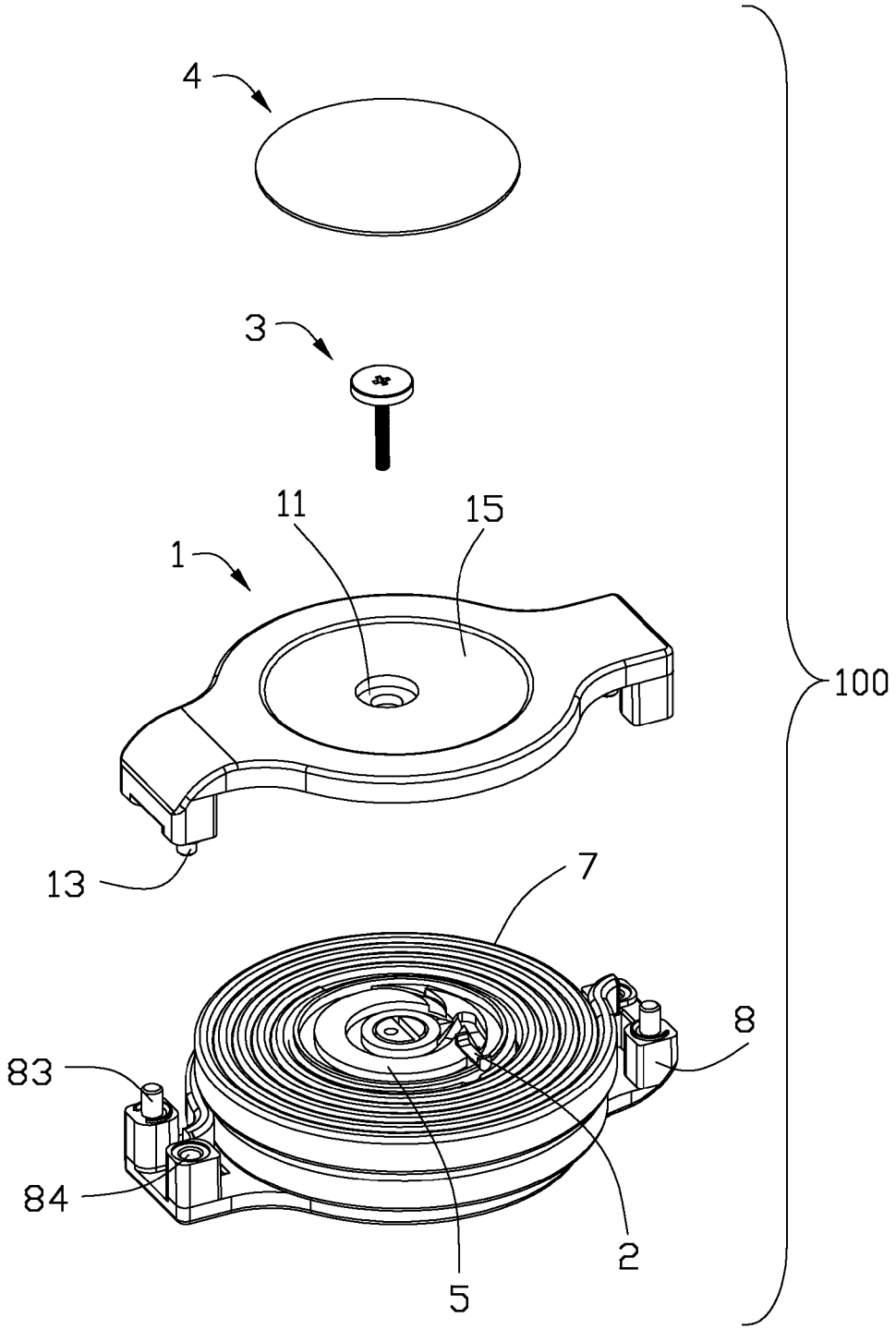
FIG. 2 is a partially exploded, perspective view of the wire-winding device as shown in FIG. 1.
Figure 3:
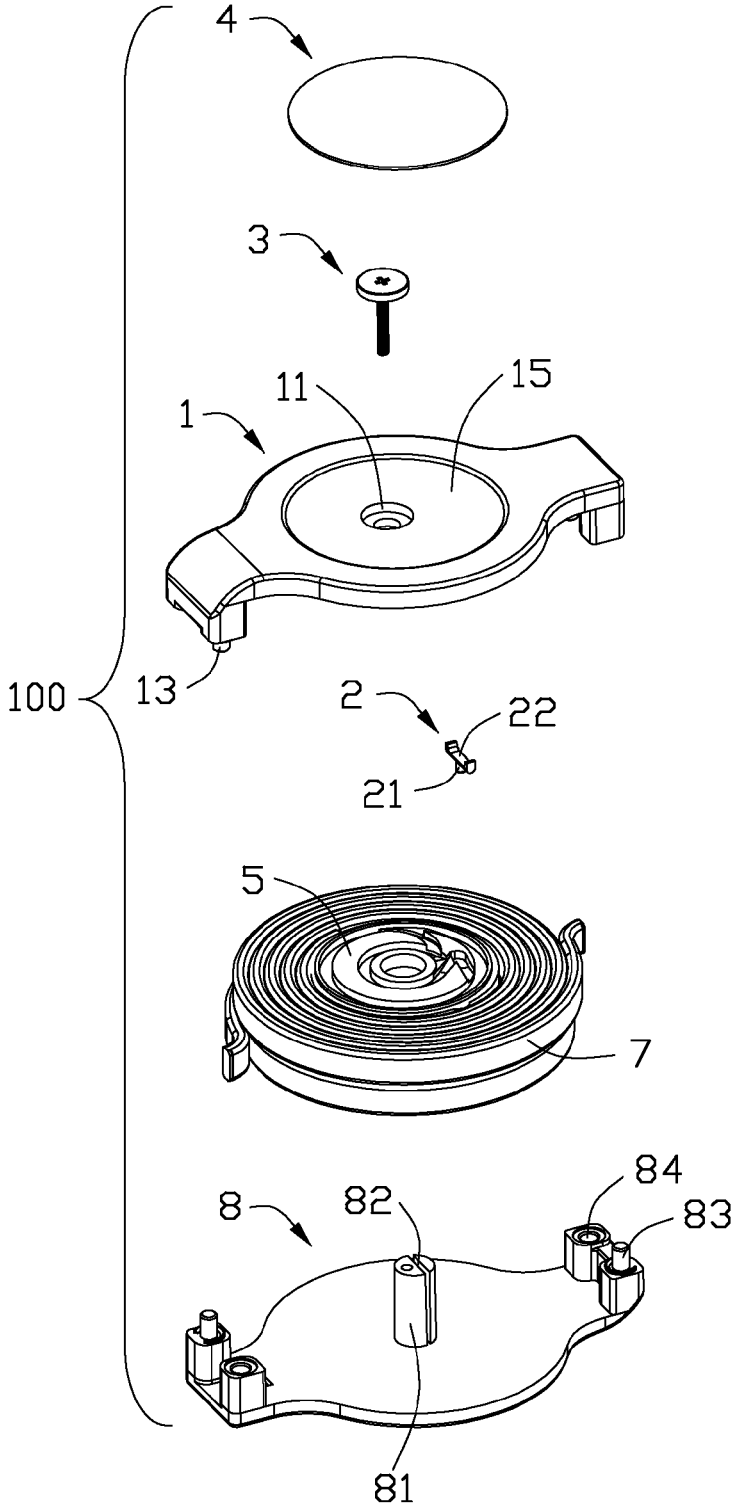
FIG. 3 is a partially exploded, perspective view of the wire-winding device as shown in FIG. 2.

Reference will now be made to the drawings to describe the present invention in detail.

Referring to FIGS. 1 to 5, an improved wire-winding device 100 according to the present invention includes an upper cover 1, a rotary base 5, a spiral spring 6 received into the rotary base 6, a transmission line 7 winding around the rotary base 6, and a lower cover 8 assembled to the upper cover 1. The transmission line 7 is divided into upper and lower rows. The upper cover 1 has a terraced through hole 11 in the center thereof. And the upper cover 1 has a circular groove 15 formed on the upper surface thereof connecting to the through hole 11, a long and narrow rectangle slot 12 deviating a center of the bottom surface of the upper cover 1, a protruding cylinder 13, and a concave hole 14 at each side of the upper cover 1.

Figure 4:
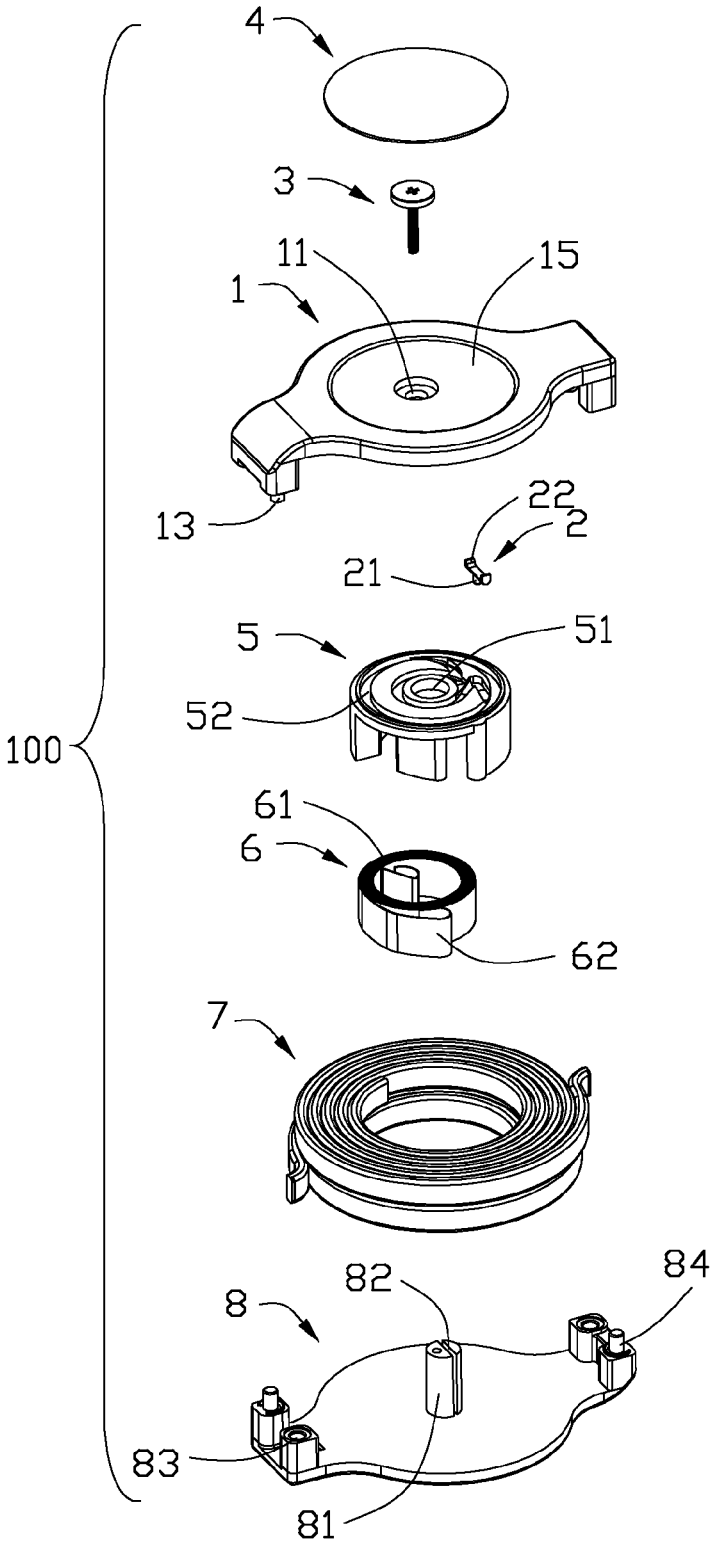
FIG. 4 is an as exploded, perspective view of a wire-winding device as shown in FIG. 1.
Figure 5:
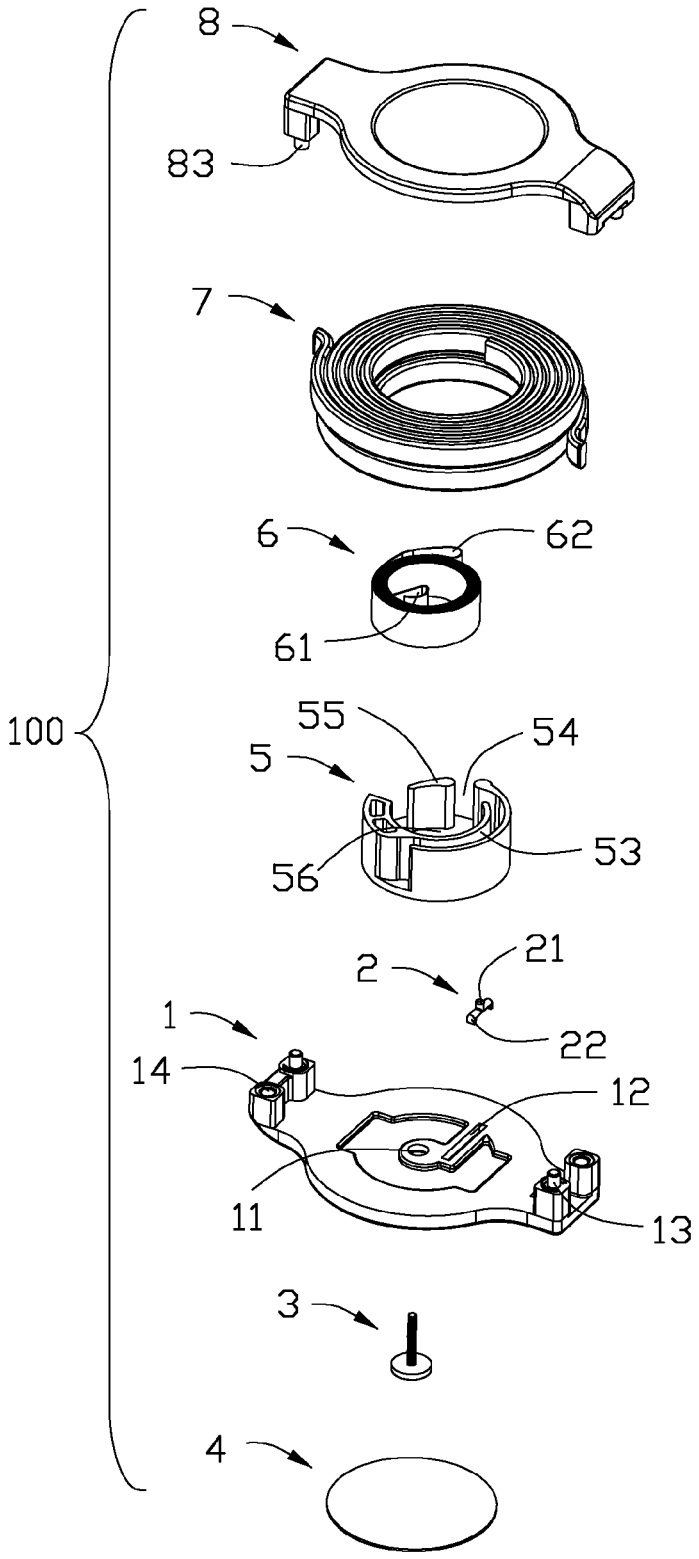
FIG. 5 is an another exploded, perspective view of the wire-winding device as shown in FIG. 4.
Figure 6A:
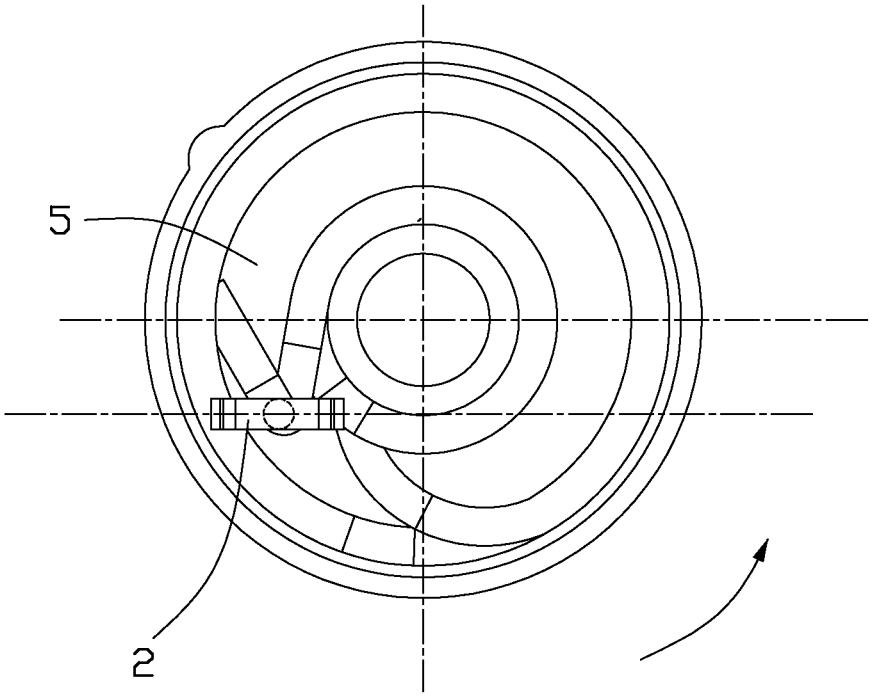
FIG. 6A to FIG. 6F are mutual action principle schematic between the elastic positioning element and the annular track.
Figure 6B:
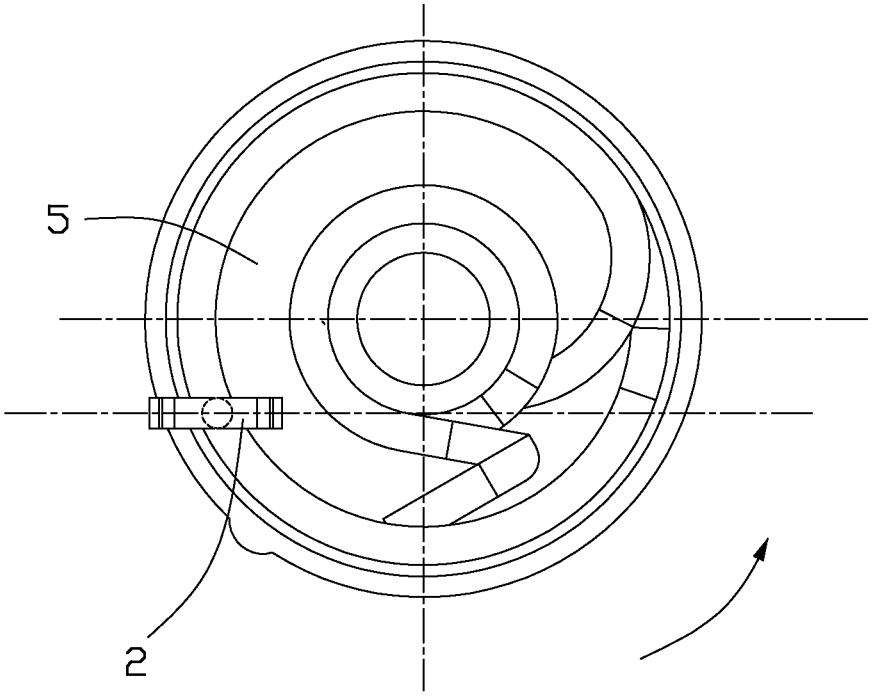
Figure 6C:
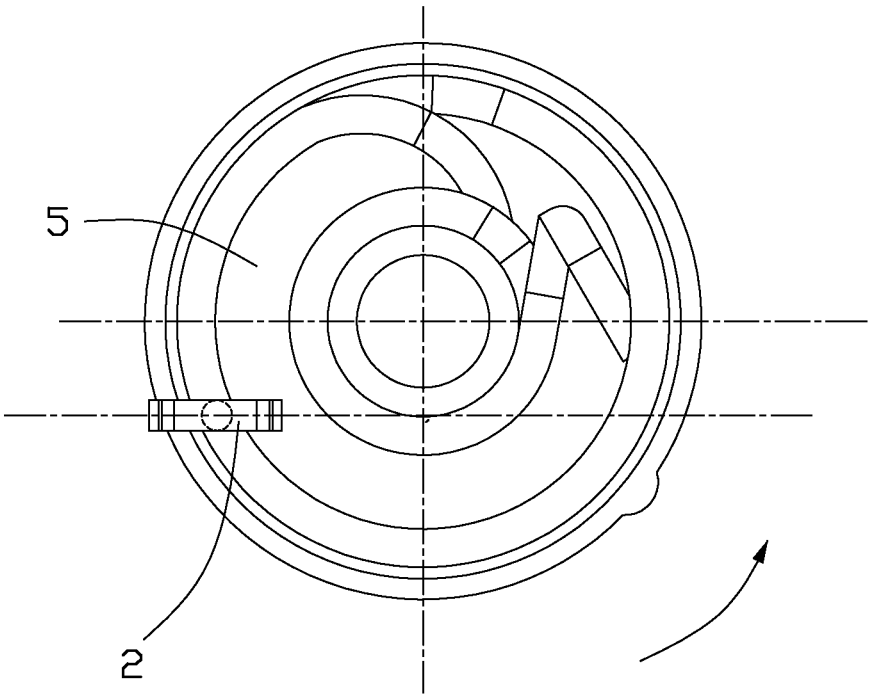
Figure 6D:
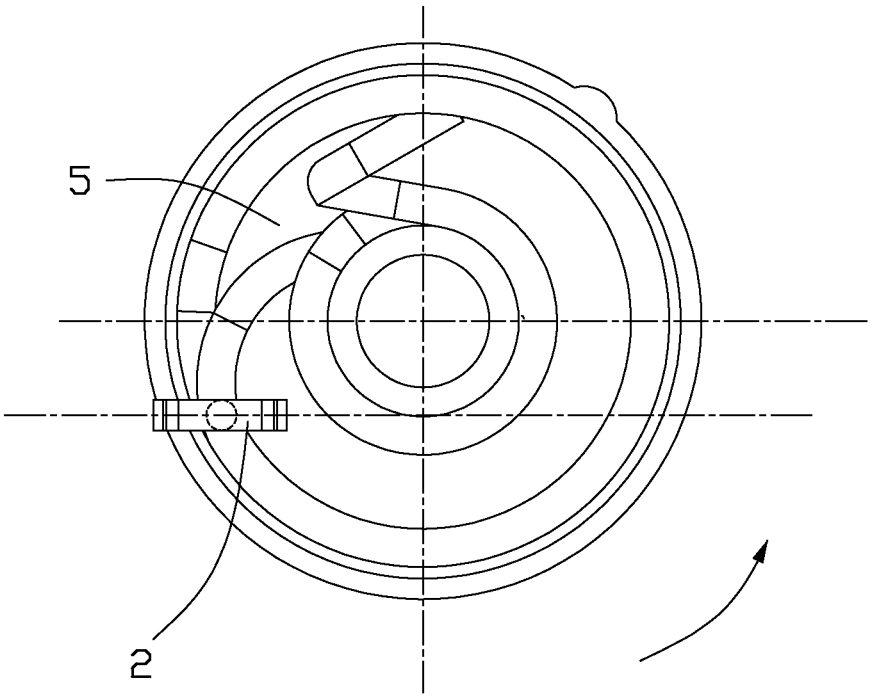
Figure 6E:
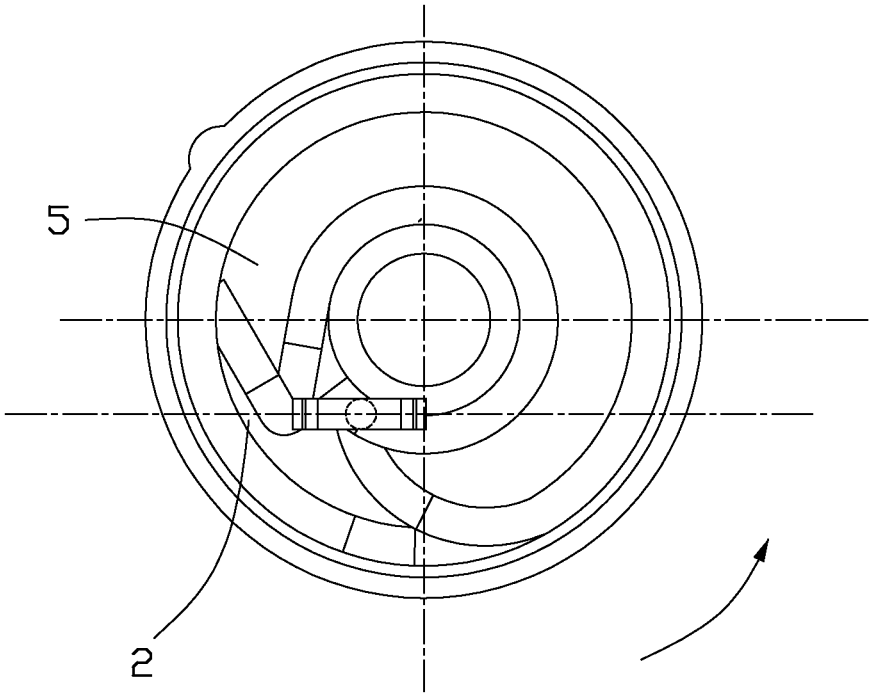
Figure 6F:
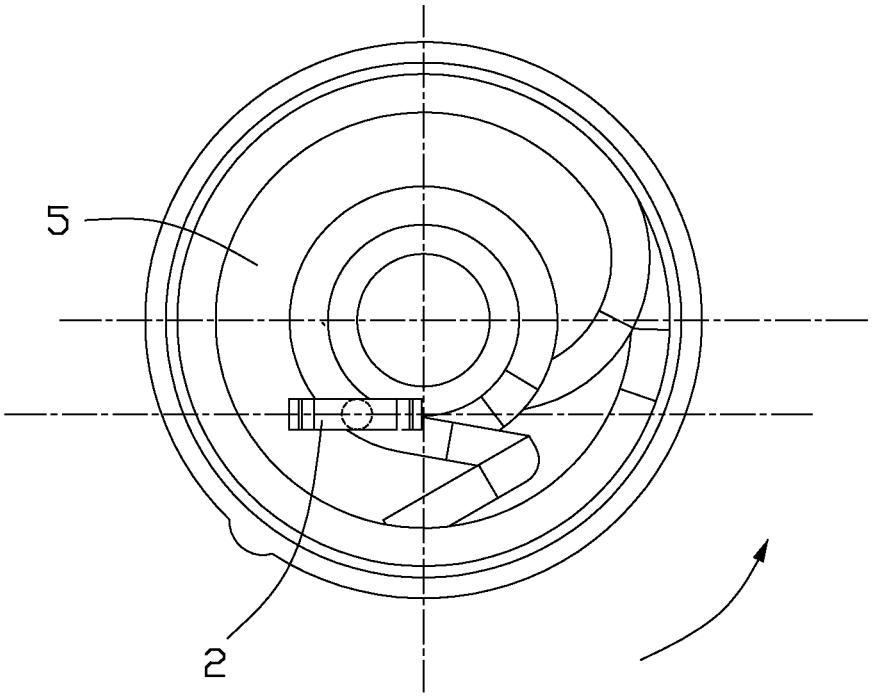

Referring to FIGS. 4 to 5, the rotary base 5 has a through hole 51 in the center thereof. The rotary base 5 has a groove 56 on the bottom surface thereof to position the spiral spring 6. The groove 56 has a pillar 55, an outlet 54, and a wire casing 53 on one side thereof. The transmission line 7 passes through the wire casing 53. The rotary base 5 has an annular track 52 on the top surface thereof. The annular track 52 includes an outer race/path, an inner race/path, and a guide rail connecting the outer race and the inner race. The annular track 52 has a step with different heights. The transmission line 7 winds around the rotary base 5.

Referring to FIGS. 4 and 5, the spiral spring 6 has a first end portion 61 and a second end portion 62. The second end portion 62 is bent into a semicircle to surround the pillar 55 of the rotary base 5. A screw column 81 extends upward from the central of the lower cover 8. The screw column 81 has a groove 82 formed on one side which receives the first end portion 61 of the spiral spring 6 to fix the spiral spring 6. The lower cover 8 has a protruding cylinder 83 and a concave hole 84 at each side of the lower cover 8.

Referring to FIGS. 2 to 5, the improved wire-winding device 100 further comprises an elastic positioning element 2, a screw 3, and a decorative piece 4. The elastic positioning element 2 has a base 22. The base 22 has a fixed part at each side and an elastic part between the fixed parts. A positioning part 21 extends from the bottom surface of the base 22. The height of the elastic part is lower than the height of the fixed part. The base 22 of the elastic positioning element 2 is accommodated to the rectangle slot 12 of the upper cover 1. The positioning part 21 is accommodated to the annular track 52. The elastic positioning element 2 moves along the orbit formed by the rectangle slot 12 of the upper cover 1 and the annular track 52 of the rotary base 5. Because of the steps with different height in the annular track 52, the positioning part 21 moves up and down in the annular track 52. And the elastic part can be deformed elastically under the upward force by the positioning part 21.

Referring to FIGS. 1 to 5, during assembling the wire-winding device 100, the spiral spring 6 is accommodated to the groove 56 of the rotary base 5 at first. The second end portion 62 of the spiral spring 6 surrounds the pillar 55 of the rotary base 5. And then the transmission line 7 passes through the wire casing 53 and the outlet 54 to make the transmission line 7 surround the rotary base 5 in same direction of the rotation. The transmission line 7 is divided into upper and lower rows. And then the rotary base 5 is installed in the lower cover 8. The first end portion 61 of the spiral spring 6 is accommodated to the groove 82 on one side of the screw column 81. Then both ends of the transmission line 7 pass through the gap between the concave hole 84 and the protruding cylinder 83. Afterwards, the positioning part 21 of the elastic positioning element 2 is accommodated to the annular track 52 of the rotary base 5. Then the upper cover 1 is installed in the lower cover 8. The base 22 of the elastic positioning element 2 is accommodated to the rectangle slot 12 of the upper cover 1 at this moment. The protruding cylinder 13 on one side of the upper cover 1 is accommodated in the concave hole 84 and the protruding cylinder 83 of the lower cover 8 is accommodated in the concave hole 14 at the other side of the upper cover 1. And then the screw 3 is screwed in the column 81 of the lower cover 8 through the through hole 11 of the upper cover 1. Finally the decorative piece 4 is accommodated in the circular groove 15 of the upper cover 15. The assembly of the wire-winding device 100 according to the present invention is accomplished through above steps.

FIGS. 6A to 6F show the interaction of the elastic positioning element 2 and the annular track 52 of the wire-winding device 100. The positioning part 21 of the elastic positioning element 2 is accommodated to the annular track 52. When the user pulls the transmission line 7 from the wire-winding device 100 in counter-clockwise direction, the rotary base 5 turns in the same direction. The annular track 52 rotates together with the base 5. The base 22 of the elastic positioning element 2 moves in the rectangle slot 22. The position of the positioning part 21 changes relative to the rotary base 5. As shown in FIGS. 6A to 6F, the annular track 52 rotates sequentially 0 degree (latching position), 180 degree, 270 degree, 360 degree, 450 degree and 630 degree, and finally back to the original latching position. It can be seen that when the transmission line 7 is pulled outwards, the rotary base 5 starts to rotate in a counter-clockwise direction. At this moment the elastic positioning element 2 starts to rotate from the latching position to the outer race. When the rotary base 5 rotates to the 270 degree, the elastic positioning element 2 rotates to the inner race in a clockwise direction through the rail which connects the outer race and the inner race. And then the elastic positioning element 2 rotates in the clockwise direction in the inner race all the time until the whole transmission line 7 is pulled out. On the contrary, when stopped pulling the transmission line 7, the rotary base 5 starts to rotate in the clockwise direction because of the restoring force of the spiral spring 6. If the elastic positioning element 2 is in the inner race of the annular track 52 at this moment, the elastic positioning element 2 rotates to the latching position in counter-clockwise direction along the inner race. If the elastic positioning element 2 is in the outer race of the annular track 52, the elastic positioning element 2 will rotate to the latching position in the counter-clockwise direction along the outer race. The elastic positioning element 2 plays an important role in movement and positioning in the annular track 52 through the guiding of the annular track 52 with the steps and the elastic deformation of elastic part of the elastic positioning element 2. The elastic positioning element 2 moves in the orbit formed by the rectangle slot 12 of the upper cover 1 and the annular track 52 of the rotary base 5. Therefore, the base 22 of the elastic positioning element 2 can realize the elastic deformation under the upward force by the positioning part 21 in order to play a role in positioning and fixing the rotary base 5. This avoids tangling of the transmission line 7.

When the improved wire-winding device 100 according to the present invention is in use, the rotary base 5 can be rotated by pulling both ends of the transmission line 7 outward. And the spiral spring 6 is compressed to pull the transmission line 7 out until the positioning part 21 reaches the latching position of the annular track 52. The user can pull the transmission line 7 out favorably through above steps. Moreover, the transmission line 7 will easily retract when the positioning part 21 is separated from the latching position of the annular track 52 and the spiral spring 6 pulls the transmission line 7 to the external interlayer of the rotary base 5 under a restoring force.

What is claimed is:

1. A wire-winding device assembly comprising:
cover means defining a receiving space therein;
a stationary slot formed in the cover means;
a rotary base located around the receiving space and rotatable with regard to the cover means, said rotary base defining an annular track;
a torsion spring fixed to both said cover means and said rotary base to constantly urge the rotary base back to move to an original position;
a transmission wire winding around the rotary base and adapted to actuate the rotary base to rotate when said transmission wire is pulled outwardly; and
an elastic positioning element defining a first section received within and moveable along said slot and a second section received within and moveable along the annular track; wherein
a depth of said annular track varies in a vertical direction to guide the second section of the elastic positioning element to move therealong up and down in the vertical direction to comply with the variant depth of said annular track.

2. The wire-winding device assembly as claimed in claim 1, wherein the slot is linear.

3. The wire-winding device assembly as claimed in claim 1, wherein the annular track includes an inner annular path and an outer annular path linked to each other with therebetween a joint which defines a latching position where the elastic positioning element resists the torsion spring to have the rotary base be in a working position instead of the original position.

4. The wire-winding device assembly as claimed in claim 1, wherein the elastic positioning element forms an elongated piece, and the first section forms two spaced parts around two opposite ends thereof while the second section forms one part around a middle portion thereof for elastic deformation of the elastic positioning element between the slot and the annular track.

5. The wire-winding device assembly as claimed in claim 1, wherein the cover means define a circular body and two opposite protrusions diametrically, and two opposite ends of the transmission wire extend outwardly via said two protrusions.

6. A wire-winding device assembly comprising:
cover means defining a receiving space therein;
a rotary base located in the receiving space and rotatable with regard to the cover means, said rotary base defining an annular track;
a torsion spring fixed to both said cover means and said rotary base to constantly urge the rotary base back to move to an original position;
a transmission wire winding around the rotary base and adapted to actuate the rotary base to rotate when said transmission wire is pulled outwardly; and
an elastic positioning element defining a protruding section received within and moveable along the annular track so as to be moveable relative to the cover means correspondingly; wherein
a depth of said annular track varies in a vertical direction to guide the protruding section of the elastic positioning element to move therealong, and said elastic positioning element deforms elastically in the vertical direction to comply with the variant depth of said annular track during moving along the annular track; and
the annular track includes an inner annular path and an outer annular path linked to each other with therebetween a joint which defines a latching position where the elastic positioning element resists the torsion spring to have the rotary base be in a working position instead of the original position.

7. The wire-winding device assembly as claimed in claim 6, wherein the elastic positioning element is moveable relative to the cover means linearly.

8. The wire-winding device assembly as claimed in claim 6, wherein the elastic positioning element is of a slender type extending along a horizontal direction perpendicular to said vertical direction.

9. The wire-winding device assembly as claimed in claim 6, wherein the cover means define a circular body and two opposite protrusions diametrically, and two opposite ends of the transmission wire extend laterally outwardly via said two protrusions.

10. The wire-winding device assembly as claimed in claim 6, wherein the cover means defines lateral openings to expose an outermost wind of the transmission wire to an exterior.

* * * * *